US010197056B2

(12) United States Patent
Alexander et al.

(10) Patent No.: US 10,197,056 B2
(45) Date of Patent: Feb. 5, 2019

(54) PUMP WITH SHAPED FACE SEAL

(71) Applicant: CIRCOR PUMPS NORTH AMERICA, LLC, Monroe, NC (US)

(72) Inventors: Philip Taylor Alexander, Matthews, NC (US); Robert E. Oehman, Cary, NC (US)

(73) Assignee: CICOR PUMPS NORTH AMERICA, LLC, Monroe, NC (US)

( * ) Notice: Subject to any disclaimer, the term of this patent is extended or adjusted under 35 U.S.C. 154(b) by 9 days.

(21) Appl. No.: 15/307,601

(22) PCT Filed: Apr. 29, 2015

(86) PCT No.: PCT/US2015/028166
§ 371 (c)(1),
(2) Date: Oct. 28, 2016

(87) PCT Pub. No.: WO2015/168220
PCT Pub. Date: Nov. 5, 2015

(65) Prior Publication Data

US 2017/0058894 A1 Mar. 2, 2017

Related U.S. Application Data

(60) Provisional application No. 61/986,924, filed on May 1, 2014.

(51) Int. Cl.
*F03C 2/00* (2006.01)
*F03C 4/00* (2006.01)
(Continued)

(52) U.S. Cl.
CPC ..... *F04C 15/0026* (2013.01); *F04C 2/086* (2013.01); *F04C 2/18* (2013.01);
(Continued)

(58) Field of Classification Search
CPC ..... F04C 2/086; F04C 2/18; F04C 15/0026; F04C 15/0034; F04C 15/0038;
(Continued)

(56) References Cited

U.S. PATENT DOCUMENTS 3,427,985 A 2/1969 Difford
5,022,837 A 6/1991 King et al.
(Continued)

OTHER PUBLICATIONS

International Search Report and Written Opinion dated Jul. 22, 2015 for PCT Application, PCT/US2015/028166 filed Apr. 29, 2015.
(Continued)

*Primary Examiner* — Theresa Trieu

(57) ABSTRACT

A sealing arrangement is disclosed for use in a pump. The sealing arrangement can include a first pump component having a first face surface. The first face surface can have a sealing protrusion thereon. A second pump component can have a second face surface positioned in confronting relation to the first face surface. The second pump component can define a sealing cavity for holding a fluid under pressure. The sealing protrusion is positioned to engage the second face surface when the first face surface is pressed against the second face surface so that the sealing protrusion seals against the second face surface to prevent movement of the fluid from the sealing cavity past the sealing protrusion. Other embodiments are described and claimed.

19 Claims, 6 Drawing Sheets

(51) Int. Cl.

| | |
|---|---|
| ***F04C 2/00*** | (2006.01) |
| ***F04C 15/00*** | (2006.01) |
| ***F04C 2/08*** | (2006.01) |
| ***F04C 2/18*** | (2006.01) |

(52) U.S. Cl.
CPC ..... *F04C 15/0003* (2013.01); *F04C 15/0034* (2013.01); *F04C 2230/92* (2013.01); *F04C 2240/30* (2013.01); *F04C 2240/605* (2013.01); *F04C 2240/805* (2013.01)

(58) Field of Classification Search
CPC ..... F04C 15/0003; F04C 2240/30; F04C 2240/605; F04C 2240/805; F04C 2230/92
USPC ..... 418/104, 131–133, 149, 206.1–206.9
See application file for complete search history.

(56) References Cited

U.S. PATENT DOCUMENTS

| | | | |
|---|---|---|---|
| 5,544,897 | A | 8/1996 | Di Pietro et al. |
| 6,689,222 | B2 | 2/2004 | Titel et al. |
| 7,789,642 | B2 | 9/2010 | Tsuruoka et al. |
| 2003/0015288 | A1 | 1/2003 | Titel et al. |
| 2013/0259729 | A1 | 10/2013 | Alexander et al. |

OTHER PUBLICATIONS

Extended European Search Report dated Nov. 30, 2017 for EPO Application No. 15785835.8.

PUMP WITH SHAPED FACE SEAL

CROSS-REFERENCE TO RELATED APPLICATIONS

The present application claims priority to Provisional U.S. Pat. App. No. 61/986,924 by Alexander et al., titled "Pump with Shaped Face Seal," filed on May 1, 2014, which is incorporated by reference herein in its entirety and for all purposes.

FIELD OF THE DISCLOSURE

The disclosure generally relates to sealing arrangements for pump assemblies, and more particularly to a shaped face seal for use in gear pumps.

BACKGROUND OF THE DISCLOSURE

Gear pumps often include a housing or plate that holds a set of intermeshing gears. As the gears turn, fluid moves between the gear teeth and the housing and is expelled out the pump due to the intermeshing of the gears. The gears are attached to shafts that run axially from the gear faces, and these shafts run on one or more bearing surfaces.

As will be appreciated, during operation it is desirable to seal the housing and plate components, including shaft sealing components, in a manner that prevents process fluid from leaking out of the pump. Often o-rings, gaskets or other sealants are disposed between the opposing sealing surfaces to prevent such leakage. In other cases sealing is achieved between a pair of opposing metal surfaces that are formed to be extremely flat and parallel and very smooth (i.e., they have a fine surface finish).

When using o-rings and gaskets, issues can arise when the operating temperature of the pump exceeds the maximum temperature of the sealing component or where the o-ring material is incompatible with the fluid being pumped (e.g., where the pumped fluid is corrosive or otherwise harsh). This can cause the sealing component to degrade or disintegrate, thereby affecting its ability to seal. When using metal-to-metal face seals, the two mating faces will not produce an effective seal at high pressure or low viscosity unless the surface finish of the opposing surfaces is very fine. The opposing surfaces must also be very flat and parallel. If a rough surface finish is used, or if the surfaces are not sufficiently flat and parallel, the joint will leak.

Thus, there is a need for a high temperature face sealing arrangement that eliminates the need for an o-ring, gasket or other secondary sealing component, and which can be used to effectively seal joints at high temperatures and pressures.

SUMMARY OF THE DISCLOSURE

A face sealing arrangement is disclosed for use with a pump. The face seal can be a metal-to-metal seal disposed on surfaces that require neither lapping nor a very fine surface finish. The disclosed face sealing arrangement is suitable for applications in a variety of applications, one non-limiting exemplary embodiment being one in which operating temperatures exceed 500 degrees Fahrenheit.

A sealing arrangement for a pump is disclosed, and may include a sealing sleeve having a body portion and a flange portion, the flange portion having a first flange face and a second flange face. The first flange face may be configured to contact a face plate with an opening. The opening can receive the body portion of the sealing sleeve therein. The sealing arrangement may further include a lip seal housing with a face configured to contact the second flange face. The face of the lip seal housing may have a recess, and the recess may be able to receive a lip seal, such that pressing the face of the lip seal housing against the second flange face may cause the lip seal to form a face seal between the lip seal housing and the sealing sleeve.

A sealing arrangement for a pump is disclosed, and may include a first pump component having a first face and a second pump component having a second face, one of the first face and the second face having a sealing protrusion thereon. The second face may be positioned in confronting relation to the first face. The second pump component may define a sealing cavity for holding a fluid under pressure. The sealing protrusion may be positioned to engage an opposing face when the first face and the second face are pressed together so that the sealing protrusion seals against the opposing face to prevent movement of the fluid from the sealing cavity past the sealing protrusion.

A method is disclosed for sealing a pump is disclosed. The method may include: preventing movement of a fluid from a sealing cavity past a sealing protrusion, comprising: a first pump component having a first face; and a second pump component having a second face positioned in confronting relation to the first face, the second pump component including an opening in fluid communication with the sealing cavity, wherein one of the first face and the second face has the sealing protrusion thereon, wherein the sealing protrusion is positioned to engage an opposing face when the first face and the second face are pressed together so that the sealing protrusion seals against the opposing face.

BRIEF DESCRIPTION OF THE DRAWINGS

By way of example, a specific embodiment of the disclosed device will now be described, with reference to the accompanying drawings, in which.

DETAILED DESCRIPTION

Figure 1:
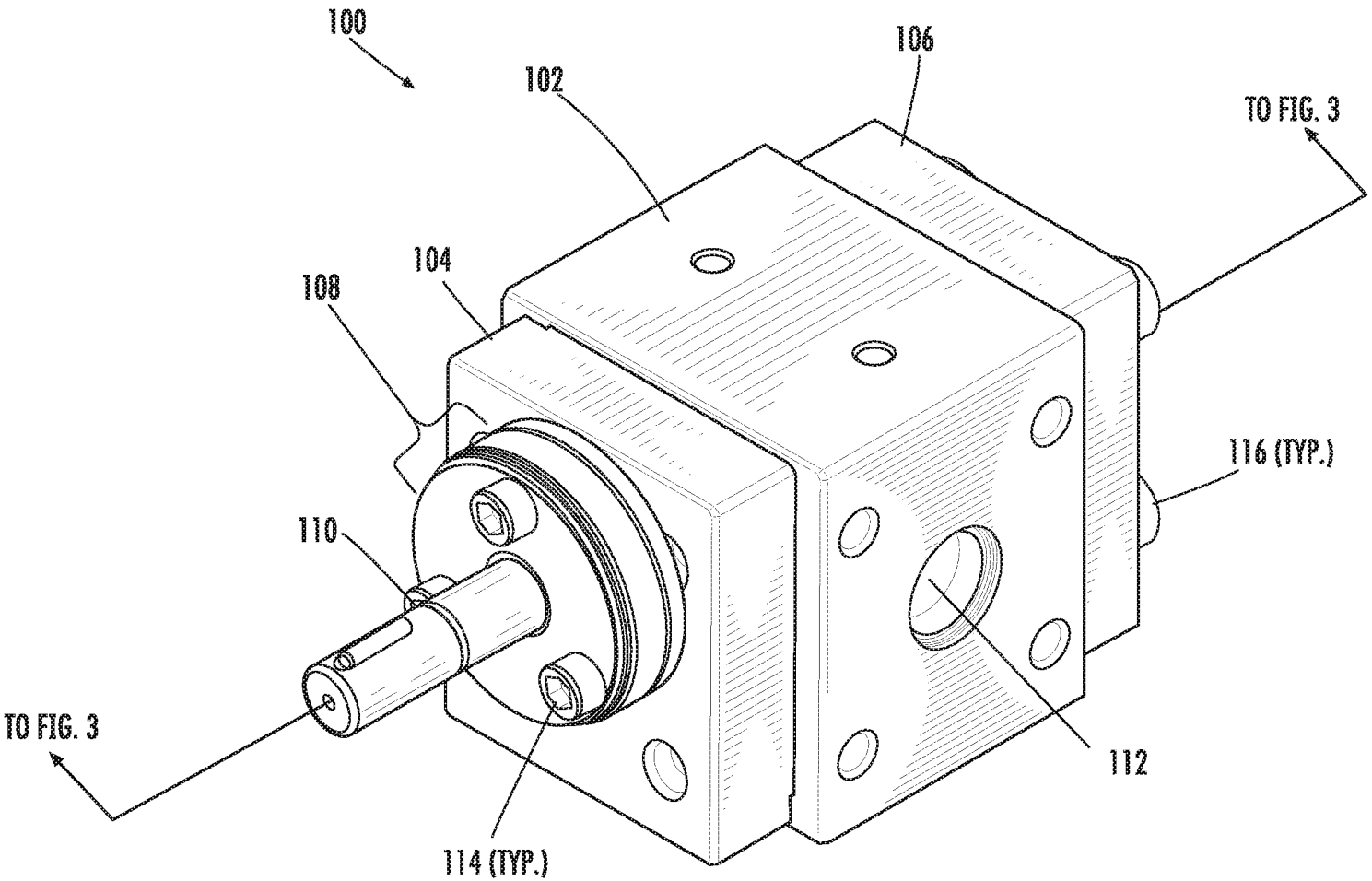
FIG. 1 is an isometric view of a pump according to the disclosure.

A sealing arrangement is disclosed for use in sealing opposing face surfaces in a pump. In one embodiment the sealing arrangement includes a metal-to-metal face seal in which a small surface feature is provided on one of the opposing surfaces. The sealing feature extends all the way around the cavity that requires sealing. The surface feature may be a protrusion that causes a line contact seal to be formed between the opposing faces so that high forces applied at this line contact create an effective seal at high temperatures and pressures, and with low pumped fluid viscosities.

In some embodiments the protrusion symmetrically or asymmetrically comes to a point so that one area protrudes away from the surrounding surface by a greater degree than the rest of the protrusion so that it contacts a flat mating surface of the opposing surface, thus creating the aforementioned line contact. The surface associated with the protrusion may extend radially outward sufficiently that bolt holes can be provided. Bolts may thus be used to apply force on a flange so that the protrusion is loaded against the mating seal face. The force from the bolts creates a desired high line contact force where the protrusion engages the opposing surface. The area that is in contact and under high contact force produces the desired seal.

In one embodiment, the seal feature is a circumferential protrusion having a radial cross-section. It will be appreciated, however, that the protrusion can have other cross-sectional geometries, such as elliptical, triangular or other geometric or non-geometric shapes.

It will also be appreciated that the disclosed seal can be used in any location where an o-ring or gasket is typically used, such as on flange faces. In one embodiment the disclosed seal is used on the flange face of a shaft sealing sleeve for a polymer extrusion pump (PEP), where the operating temperature of the PEP pump is too high for an o-ring, and where a gasket would be too small and cumbersome for the application.

Referring now to FIGS. 1-4, an exemplary gear pump 100 is shown. The pump 100 may include a central gear plate 102, front and rear plates 104, 106, a shaft seal assembly 108 and a drive shaft 110. An inlet port (not shown) and an outlet port 112 may be formed in the central gear plate for moving fluid through the pump 100. The inlet and outlet ports may be coupled to inlet and outlet piping or tubing using a suitable c-ring 113. The pump 100 may be fixed in its assembled form via a plurality of fasteners 114, 116, which in the illustrated embodiment are socket head cap screws.

Figure 2:
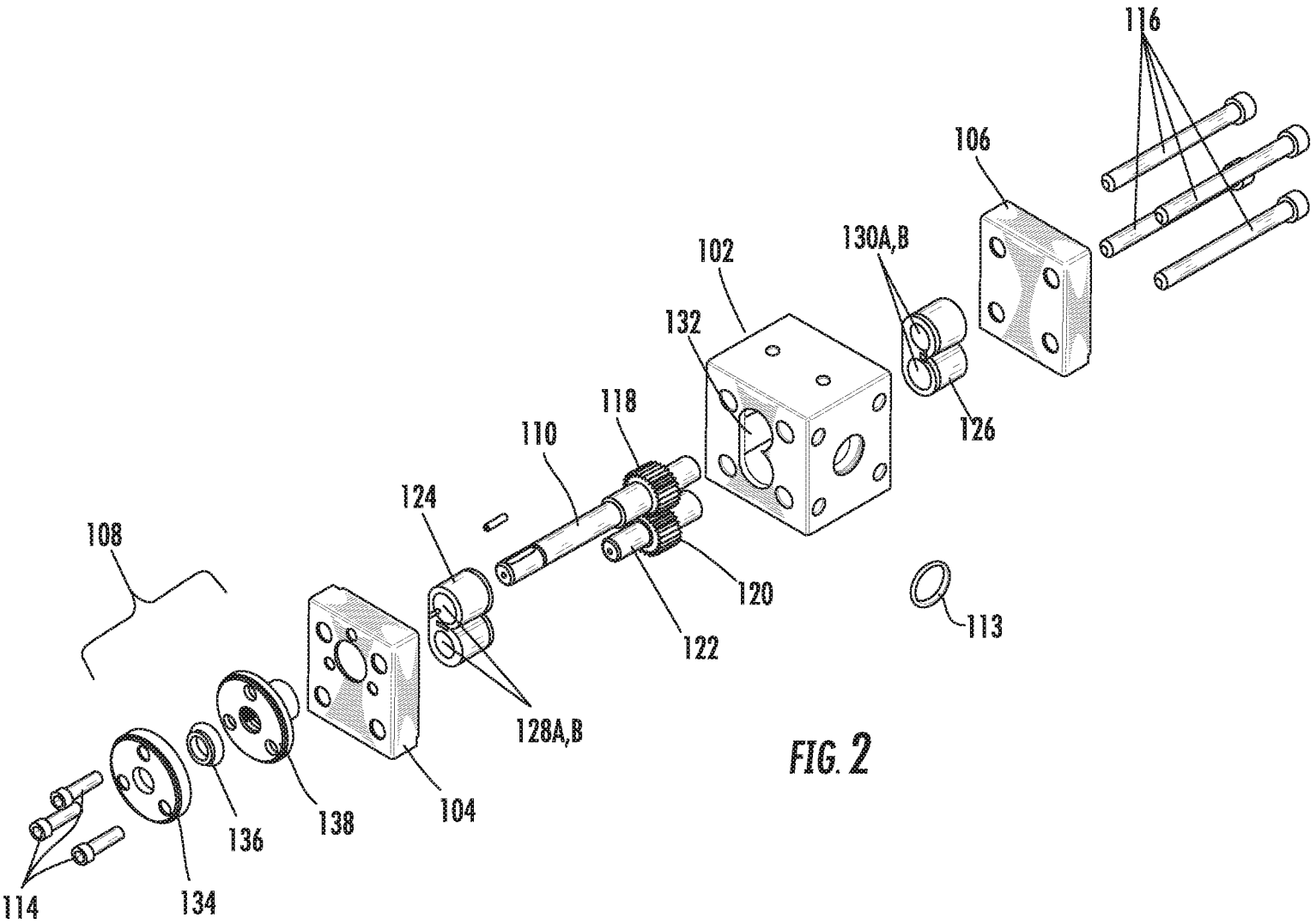
FIG. 2 is an exploded view of the pump of FIG. 1.
Figure 3:
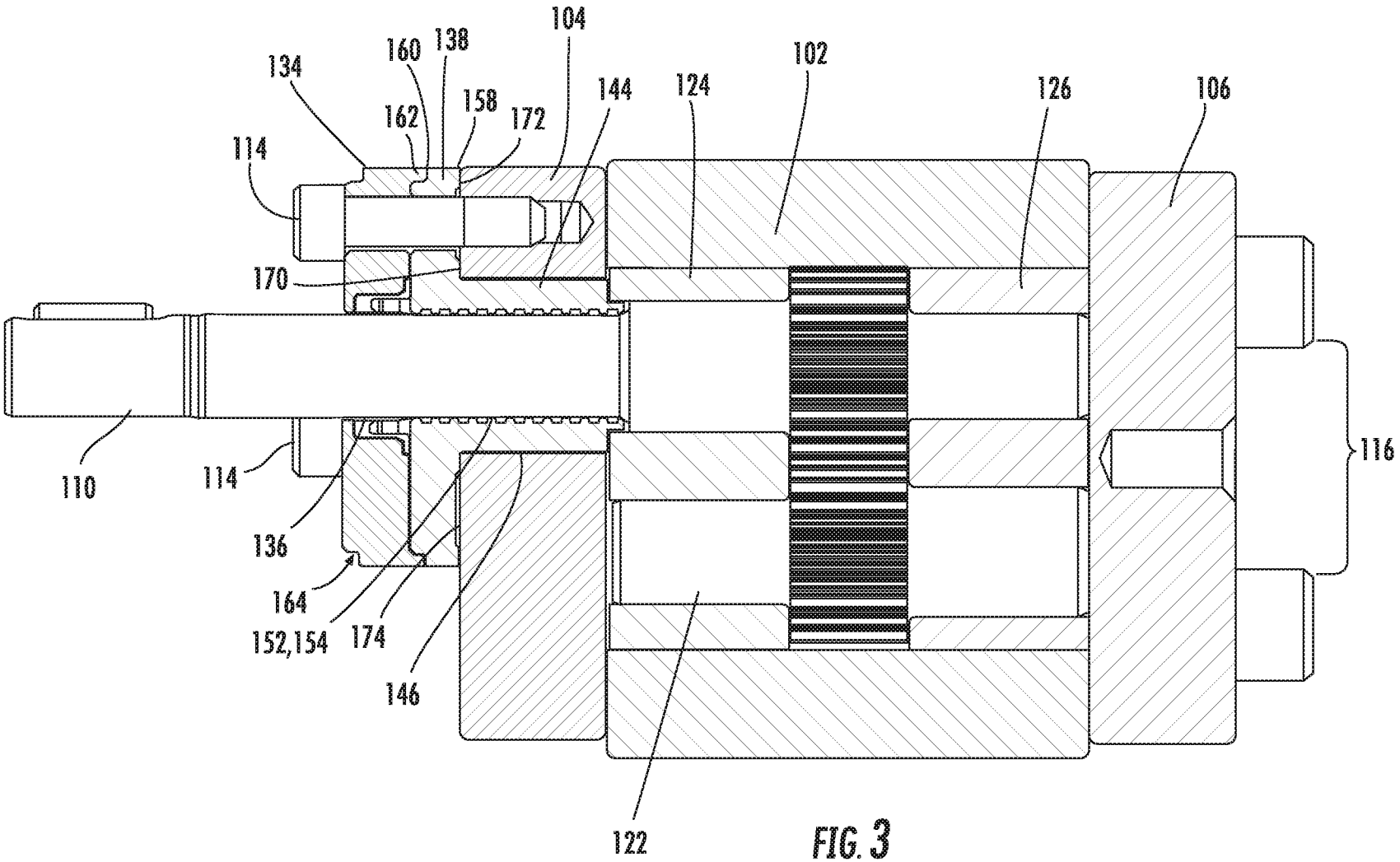
FIG. 3 is a cross-section of the pump of FIG. 1 taken along line 3-3 of FIG. 1.

FIG. 2 shows the pump 100 in exploded form. As can be seen, a drive shaft 110 includes a first gear 118 which intermeshes with a second gear 120 of a driven shaft 122. First and second asymmetrical bearings 124, 126 are positioned on opposite sides of the first and second gears 118, 120 and receive the drive shaft 110 and driven shaft 122 via respective bores 128A, B, 130A, B, respectively. These asymmetrical bearings 124, 126 may be substantially the same as those disclosed in pending U.S. patent application Ser. No. 13/850,884, filed Mar. 27, 2014, and titled "Gear Pump with Asymmetrical Dual Bearing," the entirety of which is incorporated by reference herein. It will be appreciated that the bearing style is not critical to the disclosure, and other bearing forms can be used. The first and second gears 118, 120 and first and second asymmetrical bearings 124, 126 are received within an asymmetrical opening 132 in the central gear plate 102.

The shaft seal assembly 108 may include a plurality of sealing elements configured to prevent fluid leakage around the drive shaft 110. In the illustrated embodiment, the shaft seal assembly 108 comprises a lip seal housing 134, a lip seal 136 and a sealing sleeve 138, which may be fixed together in the stacked relation shown in FIG. 3. The lip seal 136 may be held in a recess formed in the lip seal housing 134 and may form a radial seal around the drive shaft 110, and may form a face seal between the sealing sleeve 138 and the lip seal housing 134.

A cylindrical body portion 144 of the sealing sleeve 138 may be received in an opening 146 of the front plate 104. The sealing sleeve 138, lip seal 136 and lip seal housing 134 may all have corresponding central bores which receive a portion of the drive shaft 110 therethrough. The central bore 152 of the sealing sleeve 138 may include a helical groove 154 for sealing against the surface of the drive shaft 110. The helical groove 154 allows the sealing sleeve 138 to act as a screw-type pump during operation. As fluid attempts to leave the gear pump (around the outer diameter of the drive shaft 110), the shaft's rotary motion forces the fluid into the groove 154. This creates a pressure greater than the pressure forcing the fluid out of the pump, and forces the fluid back toward the central gear plate 102. Thus arranged, the pumped fluid is prevented from leaking past the drive shaft 110 during operation.

The pump 100 may also include alignment, or "piloting" features on the sealing elements, thus improving concentricity between the axes of the sealing elements and the axis of the shaft, which are otherwise independent features. As shown, the sealing sleeve 138 includes a flange portion 158 having a forward facing circumferential alignment recess 160 disposed adjacent to the perimeter of the flange portion. As will be appreciated this alignment recess 160 can be used to align one or more secondary seals. In the illustrated embodiment, the alignment recess 160 receives a rearward protruding circumferential lip portion 162 of the lip seal housing 134. By fitting the circumferential lip portion 162 into the alignment recess 160, a desired high degree of concentricity between the axis of the drive shaft 110 and the lip seal axis can be achieved. As shown, the lip seal housing 134 includes its own alignment recess 164 disposed on a forward facing portion of the housing. This alignment recess 164 can be used to align additional sealing elements (not shown), as desired.

During assembly, the sealing sleeve 138 may be bolted to the front plate 104. There may be a loose clearance fit between the outer surface of the cylindrical body portion 144 of the sealing sleeve and the front plate 104. Since the sealing sleeve is not tightly located on the front plate 104, this loose fit reduces the chances of pump binding during assembly, when the fasteners 114 are tightened.

Figure 4:
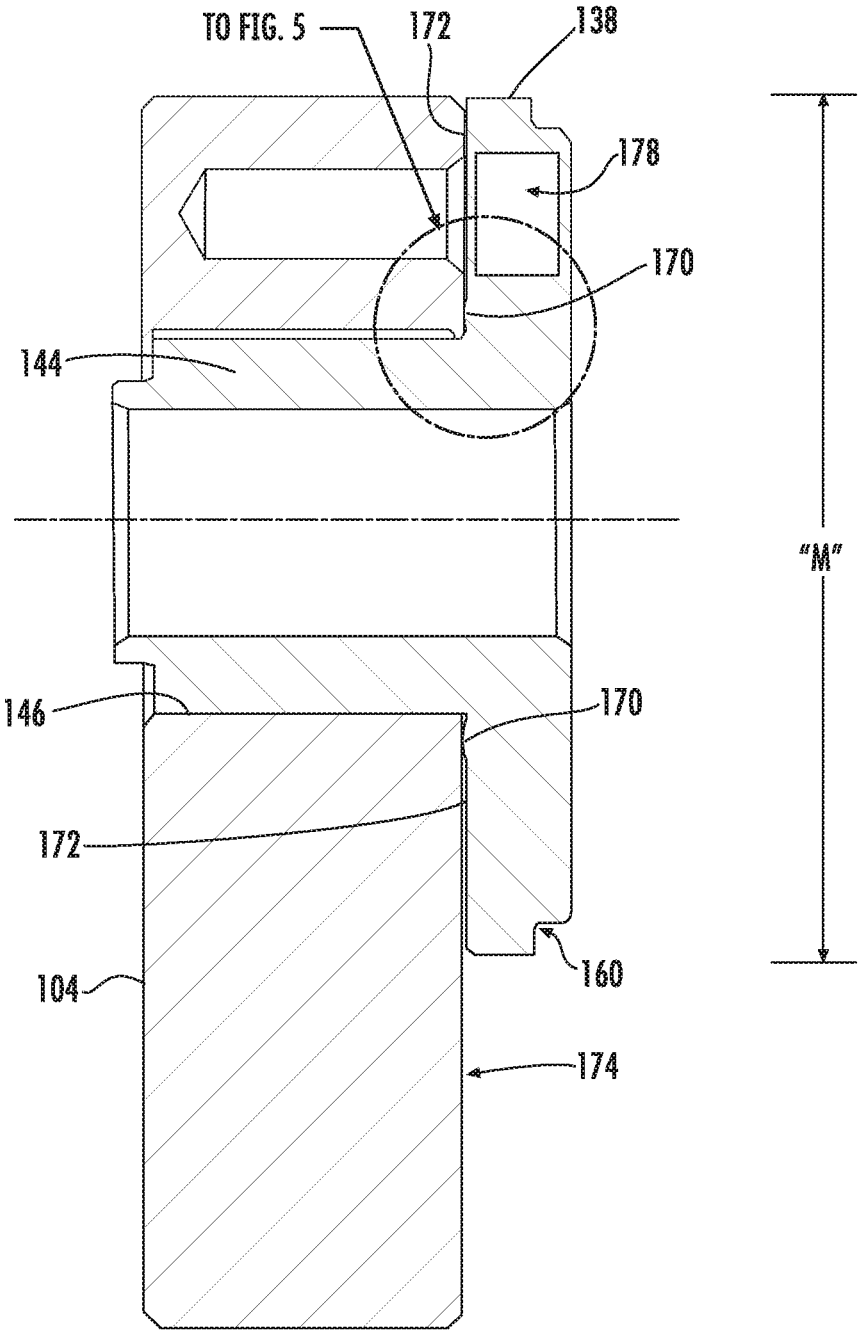
FIG. 4 is a detail view of a portion of the cross-section view of FIG. 3.
Figure 5:
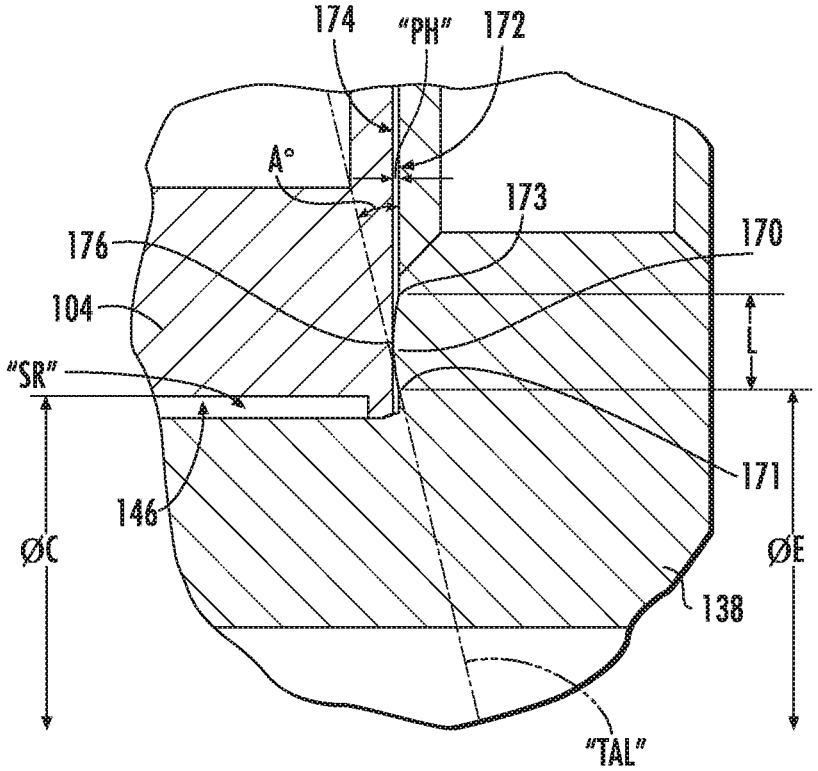
FIG. 5 is a first detail view of a portion of FIG. 4.
Figure 6:
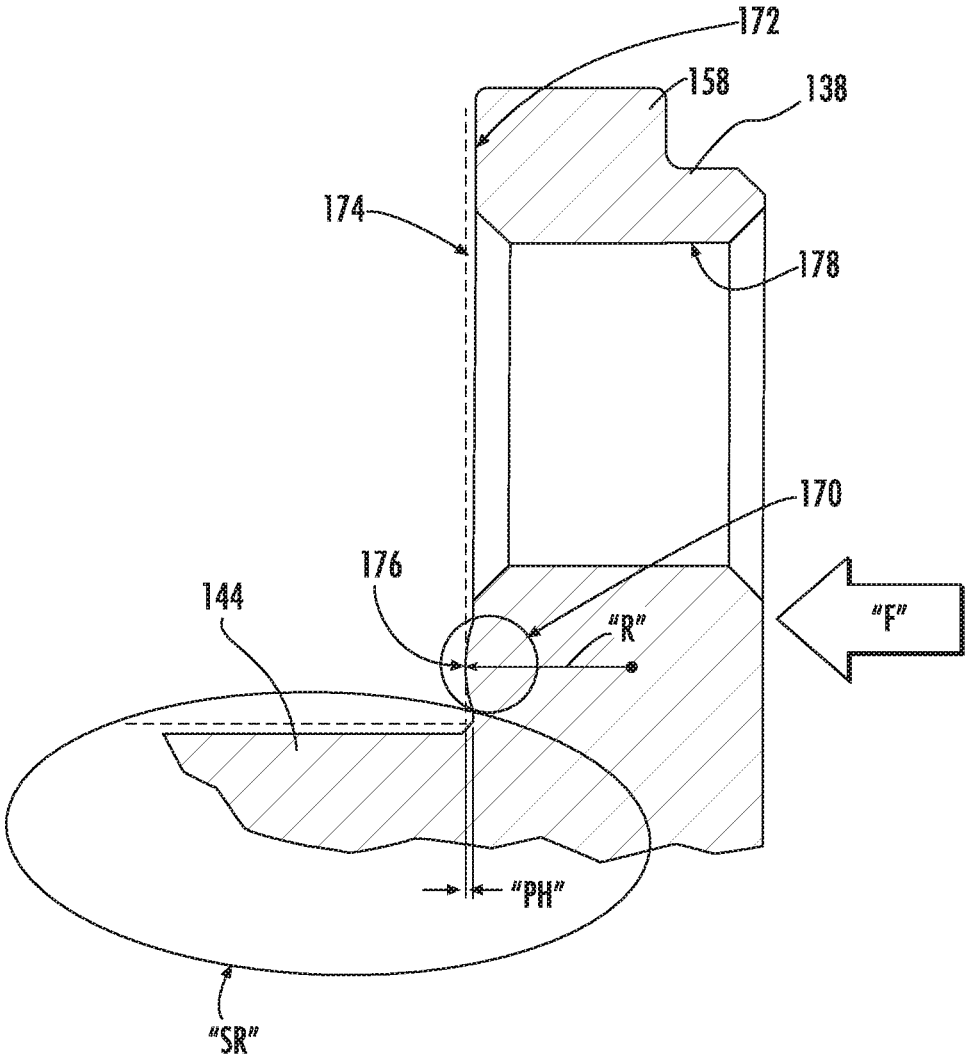
FIG. 6 is a second detail view of a portion of FIG. 4.

As can be seen in FIGS. 4-6, the sealing protrusion 170 is disposed on a first face surface 172 of the flange portion 158 of the sealing sleeve 138. In the illustrated embodiment the sealing protrusion 170 is positioned directly adjacent to the cylindrical body portion 144 of the sealing sleeve 138. Although not visible in this view, it will be appreciated that the sealing protrusion 170 runs in a continuous circular manner about the circumference of the cylindrical body portion 144 so as to form a sealing "ring" arrangement.

The first face surface 172 is positioned in confronting relation to an opposing second face surface 174 of the front plate 104 so that the sealing protrusion 170 is disposed directly adjacent to the opening 146 in the front plate 104. Thus arranged, tightening the fasteners 114 causes the lip seal housing 134 to press the sealing sleeve 138 against the front plate 104, forcing the sealing protrusion 170 against the second face surface 174 of the front plate. The sealing protrusion 170 thereby forms a line contact seal with the second face surface 174 of the front plate 104. This effectively seals off the opening 146 in the front plate 104 and prevents fluid from the interior of the pump 100 from passing out of the opening.

FIG. 6 shows sealing sleeve 138 including the first face surface 172 and the sealing protrusion 170 extending therefrom. The front plate 104 and its associated second face surface 174 are shown in dashed lines. In this embodiment the sealing protrusion 170 has having a circular cross-section of radius "r." In one non-limiting exemplary embodiment this radius can be from about 0.140 inches to about 0.150 inches. In addition, the sealing protrusion 170 has a protrusion height "PH" as measured from the first face surface 172 to a contact portion 176 of the sealing protrusion. In one non-limiting exemplary embodiment this protrusion height can be from about 0.004 inches to about 0.006 inches. The sealing protrusion 170 may also have a protrusion length "L" (FIG. 5) which can have dimensions that will be described in greater detail below.

Force applied to the sealing sleeve 138 by the fasteners 114 (disposed in fastener holes 178) is illustrated as arrow "F." The region requiring sealing (i.e., the interior of the pump cavity) is illustrated as region "SR."

Referring to FIG. 5, the following rules can apply for sizing the disclosed sealing arrangement:

(1) The size of the sealing cavity (e.g., the diameter of the opening 146 in the front plate 104), as a diameter, can be defined as "C." The inner radial edge 171 of the sealing protrusion 170, as a diameter, can be defined as "E." "E" should be at least 0.005-inches greater than "C."

(2) The length of the sealing protrusion 170 (i.e., the distance between the inner radial edge 171 and the outer radial edge 173 can be defined as "L." The maximum outer diameter of the flange portion 158 of the sealing sleeve 138 is defined as "M" (see FIG. 4.) "L" should be 5-10% of the size of "C," but no larger than 3% of "M."

(3) The distance that the seal feature protrudes from the first face surface 172 can be defined as "PH." "PH" should be 7-10% of "L," but not greater than 0.015-inches.

(4) A tangent angle line "TAL" exists that intersects the inner radial edge 171 of the sealing protrusion 170, and is also tangent to the sealing protrusion profile. The angle of this line relative to the first face surface 172 can be defined as "A." "A" should be no greater than 85% of the cutting angle of the tool used to produce the sealing protrusion 170 profile. This limitation prevents the tool from damaging the part when the profile is being generated.

(5) The surface finish of the sealing protrusion 170 should be better than or equal to 32 Ra. The surface finish of the second face surface 174 can be 16 Ra or better.

As previously noted, the sealing protrusion 170 can take any of a variety of cross-sectional shapes in addition to the disclosed circular cross-section. For example, the sealing protrusion 170 may have a triangular shape, an elliptical shape, or the like.

In addition, although the sealing protrusion 170 is described as being a continuous circular protrusion disposed about the cylindrical body portion 144 of the sealing sleeve 138 (i.e., a circular ring), it will be appreciated that the sealing protrusion need not form a "circular" seal ring. Other geometric and non-geometric shapes could be employed. The sealing protrusion may be milled, cast, turned or permanently molded on the first face surface 172. In addition, more than one sealing protrusion could be used, as desired.

Further, although the sealing protrusion 170 is described as being formed on the first face surface 172 of the sealing sleeve 138, it could instead be formed on the second face surface 174 of the front plate 104. In such a case the first face surface 172 would be flat, and the sealing protrusion 170 would bear against it upon application of force via the fasteners 114. In addition, one or more sealing protrusions could be formed on other surfaces of the pump 100 in which flat surfaces are placed in confronting relation. For example, the disclosed sealing arrangement could be used between any of the plates in the pump, eliminating the need for using other metal-to-metal seals or o-rings. In addition, the disclosed sealing arrangement could be very used on port flanges in lieu of the c-rings 113 (see FIG. 2)

Based on the foregoing information, it will be readily understood by those persons skilled in the art that the invention is susceptible of broad utility and application. Many embodiments and adaptations of the invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the invention or otherwise exclude any such other embodiments, adaptations, variations, modifications or equivalent arrangements; the invention being limited only by the claims appended hereto and the equivalents thereof. Although specific terms are employed herein, they are used in a generic and descriptive sense only and not for the purpose of limitation.

What is claimed is:

1. A sealing arrangement for a pump, comprising a sealing sleeve having a first face; and a front plate having a second face positioned in confronting relation to the first face, the front plate defining a sealing cavity for holding a fluid under pressure, wherein one of the first face and the second face has a sealing protrusion thereon, wherein the sealing protrusion is positioned to engage an opposing face of one of the first face and the second face when the first face and the second face are pressed together so that the sealing protrusion seals against the opposing face to prevent movement of the fluid from the sealing cavity past the sealing protrusion.

2. The sealing arrangement of claim 1, wherein the sealing protrusion has a geometric cross-sectional shape.

3. The sealing arrangement of claim 1, wherein the sealing protrusion has a non-geometric cross-sectional shape.

4. The sealing arrangement of claim 1, wherein the sealing protrusion is disposed about a cylindrical body portion of the sealing sleeve.

5. The sealing arrangement of claim 4, wherein the sealing protrusion engages a second face surface of the front plate around a circumference of the sealing cavity.

6. The sealing arrangement of claim 1, wherein the sealing protrusion has a circular cross-section of radius "r."

7. The sealing arrangement of claim 6, wherein the radius "r" is in a range from 0.140 inches to 0.150 inches.

8. The sealing arrangement of claim 1, wherein the sealing protrusion has a protrusion height "PH" as measured from a first face surface to a contact portion of the sealing protrusion.

9. The sealing arrangement of claim 8, wherein the protrusion height is in a range from 0.004 inches to 0.006 inches.

10. The sealing arrangement of claim 1, wherein the sealing protrusion has a protrusion length "L" as measured from an inner radial edge of the sealing protrusion and an outer radial edge of the sealing protrusion, wherein "L" is 5-10% of the size of the diameter of the sealing cavity.

11. The sealing arrangement of claim 10, wherein the protrusion length "L" is no larger than 3% of an outer diameter of a flange portion of the sealing sleeve.

12. The sealing arrangement of claim 11, wherein the sealing protrusion has a protrusion height "PH" as measured from a first face surface to a contact portion of the sealing protrusion, the protrusion height "PH" being 7-10% of the protrusion length "L," and not greater than 0.015 inches.

13. The sealing arrangement of claim 1, wherein a surface finish of the sealing protrusion is 32 Ra or better, and a surface finish of the opposing face of one of the first face and the second face is 16 Ra or better.

14. A method for sealing a pump, comprising the steps of:

preventing movement of a fluid from a sealing cavity past a sealing protrusion, comprising:

a sealing sleeve having a first face; and a front plate having a second face positioned in confronting relation to the first face, the front plate including an opening in fluid communication with the sealing cavity, wherein one of the first face and the second face has the sealing protrusion disposed thereon, wherein the sealing protrusion is positioned to engage an opposing face of one of the first face and the second face when the first face and the second face are pressed together so that the sealing protrusion seals against the opposing face.

15. The method of claim 14, wherein the sealing protrusion forms a line contact seal when the first face and the second face are pressed together.

16. The method of claim 14, wherein the sealing protrusion surrounds the opening in the second pump component.

17. The method of claim 14, further comprising the step of contacting the sealing sleeve with a lip seal housing by aligning one or more corresponding alignment features.

18. The method of claim 14, further comprising the step of pressing the first face and the second face together with one or more bolts.

19. The method of claim 14, further comprising the step of pressurizing the sealing cavity with a fluid.

* * * * *